United States Patent [19]

Usami et al.

[11] 4,281,060

[45] Jul. 28, 1981

[54] HEAT-DEVELOPABLE PHOTOSENSITIVE MATERIALS

[75] Inventors: Toshimasa Usami; Tomoyuki Kobayashi, both of Fujinomiya; Sumitaka Tatsuta, Minami-ashigara; Shigeo Komine, Odawara, all of Japan

[73] Assignee: Fuji Photo Film Co., Ltd., Minami-ashigara, Japan

[21] Appl. No.: 163,455

[22] Filed: Jun. 27, 1980

[30] Foreign Application Priority Data

Jun. 27, 1979 [JP] Japan ..... 54-80864

[51] Int. Cl.[3] ..... G03C 1/02

[52] U.S. Cl. ..... 430/618; 430/353; 430/531; 430/954; 430/961

[58] Field of Search ..... 430/618, 619, 620, 961, 430/906, 531

[56] References Cited

U.S. PATENT DOCUMENTS

| | | | |
|---|---|---|---|
| 3,846,136 | 11/1974 | Sullivan | 430/965 |
| 3,925,081 | 12/1975 | Chiklis | 430/961 |
| 4,213,784 | 7/1980 | Ikenoue et al. | 430/353 |

*Primary Examiner*—Travis Brown

*Attorney, Agent, or Firm*—Sughrue, Rothwell, Mion, Zinn and Macpeak

[57] ABSTRACT

A heat-developable photosensitive material comprising a support having coated thereon at least on sensitive layer comprising (a) a binder and at least one of (b) an organic silver salt, (c) a photocatalyst, and (d) a reducing agent wherein said heat-developable photosensitive material additionally contains (e) a polyisocyanate and a process for preparing same are disclosed.

15 Claims, No Drawings

HEAT-DEVELOPABLE PHOTOSENSITIVE MATERIALS

BACKGROUND OF THE INVENTION

1. Field of the Invention:

The present invention relates to heat-developable photosensitive materials and particularly to heat-developable photosensitive materials having preferred film properties in any stage of storage, treatment and use.

2. Description of the Prior Art:

Photographic processes using silver halide have been widely utilized hitherto, because they are excellent in photographic properties such as sensitivity or gradation as compared with electrophotographic processes or diazophotographic processes. Recently, various arts capable of obtaining images simply and rapidly have been studied and developed, where the image forming treatment of silver halide photosensitive materials is converted from a wet treatment with a developing solution into a dry treatment by heating.

At present, the most successful art in the field of sensitive materials capable of forming photographic images by dry treatment includes heat-developable photosensitive materials utilizing a composition comprising an organic silver salt, a small amount of a photocatalyst and a reducing agent as essential components as described in U.S. Pat. Nos. 3,152,904 and 3,457,075. When these photosensitive materials which are stable at a normal temperature are heated to 80° C. or more and preferably 100° C. or more after image exposure, the organic silver salt oxidizing agent in the photosensitive materials enters an oxidation-reduction reaction as a catalytic function of an exposed photocatalyst existant in the vicinity thereof to form silver, by which exposed areas of the sensitive layer rapidly blacken to form contrast between non-exposed areas (background) and, consequently, images are formed.

In this photosensitive system, though a process which allows the residual photocatalyst in the photosensitive materials after development to discolor by light is adopted, the same effect as that in case of carrying out stabilization is obtained. Since the amount of photocatalyst used is small and the greater part thereof is a white or lightly colored organic silver salt, which is difficult to blacken, even though a small amount of the photocatalyst (for example, silver halide) discolors, such slight discoloration is hardly detectable by the eyes.

The above-described heat-developable photosensitive materials are generally produced by applying a sensitive layer containing the above-described organic silver salt, a photocatalyst, a reducing agent and a binder to a support.

In the known heat-developable photosensitive materials having such a structure, the sensitive layer often adheres to heating means or suffers damage when they are brought into contact with the heating means upon thermal development. Particularly, problems arise in the case of thermal development by a heating drum; namely, the binder softens to cause separation of part of the sensitive layer and the images shift in the revolving direction of the drum. This can be prevented to some degree by providing a heat resisting top coating polymer layer on the sensitive layer, but shearing of the images can not be prevented by providing only a top coating polymer layer. Further, experience has taught that a better result is obtained when the polymer in the top coating polymer layer is different than that in the sensitive layer. In this case, however, differences in polarity (the degree of hydrophilic or oleophilic property) between the sensitive layer and the top coating polymer layer weaken other adhesion between the layers, making them susceptible to scratching or separation of the layer by adhesion (for example, a pressure-sensitive adhesive tape) during processing, etc., frequently result.

On the other hand, an undercoating layer is sometimes provided between the sensitive layer and the support in order to improve storage stability of the heat-developable photosensitive materials under high humidity as described in Japanese patent application No. (OPI) 87721/78. However, due to the difference in polarity between the polymer in the undercoating layer and the polymer in the sensitive layer, separation of layers, etc. easily result. Further, when using the particularly useful vinyl chloride type copolymer or vinylidene chloride type copolymer as the undercoating layer, it is not possible to use a thermal development apparatus in which the heating member is substantially sealed from the outside (e.g., a combination of a heating roll and a heating shoe), because moisture contained in equilibrium in the base evaporates upon heating to deform the undercoating layer, and undesirable bubbles are formed on the images.

Simultaneous multilayer application processes such as described in U.S. Pat. No. 2,761,791 have the advantages of reducing poduction cost and increasing the production rate, but to use these processes, a similar solvent, composition should be used for each layer and the same polymer is preferably used as a binder in each layer in order to balance surface tension. However, when polyvinyl butyral, widely used as a binder for sensitive layers of heat-developable photosensitive materials, is used for the top coating layer, it easily adheres to the developing apparatus by heat. Accordingly, up to now, it has been difficult to carry out multilayer simultaneous application in the field of the heat-developable photosensitive materials.

The present invention is based on the discovery that inferior film properties observed in the prior heat-developable photosensitive materials can be improved using polyisocyanates.

U.S. Pat. No. 3,846,136 discloses that the photosensitive heat-sensitive layer or other hardenable layers in heat-developable photosensitive materials can be hardened with organic or inorganic hardening agents such as aldehydes and blocked aldehydes, ketones, carboxylic and carbonic acid derivatives, sulfonate esters, sulfonyl halides and vinyl sulfonyl ethers, active halogen compounds, epoxy compounds, aziridines, active olefins, isocyanates, carbodiimides, mixed-function hardeners and polymeric hardeners such as oxidized polysaccharides like dialdehyde starch and oxy-guar-gum and the like. However, this disclosure is merely an invitation to experiment, because almost all hardening agents known for gelatino silver halide emulsion photographic-sensitive materials processed by wet treatment are enumerated and there is no example using them. In fact, according to examination by the present inventors, many of the above-enumerated hardening agents are unavailable or can not be used for the heat-developable photosensitive materials because they have ill effects on the heat-developable photosensitive materials as described in the following table. Further, the above-described isocyanates have not been used in conventional systems because of their inferior stability. Accordingly, it is difficult to predict from the description of U.S. Pat. No. 3,846,136 which hardening agents are practically effective or what kind of effect will be shown in heat-developable photosensitive materials which are different from the conventional gelatino silver halide emulsion photographic sensitive materials in binder and treatment.

Further, epoxy compounds described in U.S. Pat. No. 3,846,136 harden heat-developable photosensitive materials, but they have a tendency to increase discoloration by room light (light discoloration) after development. Further, carbodiimides have high activity and hardening ability, but they have a high physiological function and they are not preferred from the viewpoint of the public nuisance. Therefore, both are problems in use.

SUMMARY OF THE INVENTION

Accordingly, an object of the present invention is to provide improved heat-developable photosensitive materials in which the problems affecting the coating layer during thermal development, such as mechanical scratching, separation of the layer or shearing of images, etc., or the problems due to deterioration of film properties in the case of a multilayer structure, such as separation of layers or the formation of bubbles, etc., are improved without an adverse influence upon other photographic properties.

Another object of the present invention is to provide heat-developable photosensitive materials having good film properties produced by process for simultaneously applying multiple layers.

The present invention which attains the above-described objects has the following technical construction.

Namely, the present invention is a heat-developable photosensitive material comprising a support having coated thereon at least one sensitive layer comprising (a) a binder and at least one of (b) an organic silver salt, (c) a photocatalyst, and (d) a reducing agent, which is characterized by (e) a polyisocyanate in combination therewith.

DETAILED DESCRIPTION OF THE INVENTION

The polyisocyanate, component (e), used in the present invention is an isocyanates having at least two isocyanate groups and adducts thereof. In detail, there are aliphatic diisocyanates, the aliphatic residue of which has 2 to 20 carbon atoms, aliphatic diisocyanates having cyclic group(s), benzene diisocyanates, naphthalene diisocyanates, biphenyl diisocyanates, diphenylmethane diisocyanates, triphenylmethane diisocyanates, triisocyanates, tetraisocyanates, adducts of these isocyanates, and adducts of these isocyanates with di- or trihydric alcohols.

Representative examples include ethanediisocyanate, butanediisocyanate, hexanediisocyanate, 2,2-dimethylpentanediisocyanate, 2,2,4-trimethylpentanediisocyanate, decanediisocyanate, ω,ω'-diisocyanato-1,3-dimethylbenzene, ω,ω'-diisocyanato-1,2-dimethylcyclohexanediisocyanate, ω,ω'-diisocyanato-1,4-diethylbenzene, ω,ω'-diisocyanato-1,5-dimethylnaphthalene, ω,ω'-diisocyanato-n-propylbiphenyl, 1,3-phenylenediisocyanate, 1-methylbenzene-2,4-diisocyanate, 1,3-dimethylbenzene-2,6-diisocyanate, naphthalene-1,4-diisocyanate, 1,1'-dinaphthyl-2,2'-diisocyanate, biphenyl-2,4'-diisocyanate, 3,3'-dimethylbiphenyl-4,4'-diisocyanate, diphenylmethane-4,4'-diisocyanate, 2,2'-dimethyldiphenylmethane-4,4'-diisocyanate, 3,3'-dimethoxy-diphenylmethane-4,4'-diisocyanate, 4,4'-diethoxydiphenylmethane-4,4'-diisocyanate, 1-methylbenzene-2,4,6-triisocyanate, 1,3,5-trimethylbenzene-2,4,6-triisocyanate, diphenylmethane-2,4,4'-triisocyanate, triphenylmethane-4,4',4''-triisocyanate, tolylenediisocyanate and 1,5-naphthylenediisocyanate; adducts of dimers or trimers of these isocyanates (for example, an adduct of 2 mols of hexamethylenediisocyanate, an adduct of 3 mols of hexamethylenediisocyanate, an adduct of 2 moles of 2,4-tolylenediisocyanate and an adduct of 3 mols of 2,4-tolylenediisocyanate, etc.); adducts of two or more different isocyanates selected from these isocyanates; and adducts of these isocyanates and dihydric or trihydric alcohols (preferably, polyhydric alcohols having up to 20 carbon atoms such as ethylene glycol, propylene glycol, pinacol or trimethylol propane, etc.) (for example, an adduct of tolylenediisocyanate and trimethylol propane and an adduct of hexamethylenediisocyanate and trimethylol propane, etc.). Among them, adducts of isocyanates and polyhydric alcohol are particularly preferred, because they improve interlayer adhesion and have a high ability to prevent separation of layers, shear of images and the occurrence of bubbles.

The polyisocyanate may be incorporated in any part of the heat-developable photosensitive material. For example, it may be incorporated in a support (particularly, when the support is paper it may be incorporated in a sizing composition), a sensitive layer, a top coating layer, an undercoating layer or two or more of these layers. Among them, preferred embodiments are:

(1) In heat-developable photosensitive materials comprising a base and a sensitive layer, it is incorporated in the sensitive layer.

(2) In heat-developable photosensitive materials comprising a base, an undercoating layer and a sensitive layer, it is incorporated in the undercoating layer.

(3) In heat-developable photosensitive materials comprising a base, a sensitive layer and a top coating layer, it is incorporated in the top coating layer.

(4) In heat-developable photosensitive materials comprising a base, an undercoating layer, a sensitive layer and a top coating layer, it is incorporated in the undercoating layer and, if desired, the top coating layer.

The amount of the polyisocyanate used is about 0.01 to 50 parts and preferably about 0.2 to 20 parts based on 100 parts of the whole binders applied to the base.

The polyisocyanate may be added to a composition for each layer composing the above-described heat-developable photosensitive layer when preparing said composition or it may be introduced continuously in a fixed amount upon application of said composition.

The organic silver salt of component (b) used in the present invention is a substance which is colorless, white or lightly colored but produces silver (image) by reacting with a reducing agent (described hereinafter) in the presence of an exposed photocatalyst (described hereinafter) when heated to 80° C. or more and functions as the image forming component in the heat-developable photosensitive materials. As such organic silver salts, silver salts of organic compounds having an imino group, a mercapto group, a thione group or a caboxyl group have been known, examples of which include the following substances:

(1) Examples of silver salts of organic compounds having an imino group include silver salts of benzotriazoles, silver salts of phthalazinones, silver salts of benzoxazinediones, silver salts of imidazoles, silver salts of tetraazaindenes and silver salts of pentaazaindenes, etc.

(2) Examples of silver salts of organic compounds having a mercapto group or a thione group include silver salts of 2-mercaptobenzoxazoles, silver salts of 2-mercaptobenzothiazoles, silver salts of 2-mercaptobenzimidazoles and silver salts of 3-mercapto-4-phenyl-1,2,4-triazoles, etc.

(3) Examples of silver salts of organic compounds having a carboxyl group include silver salts of aliphatic carboxylic acids and silver salts of aromatic carboxylic acids (for example, silver benzoate, silver phthalate, silver phenylacetate and 4'-n-octadecyloxydiphenyl-4-carboxylic acid silver salt, etc.).

Further detailed examples of these organic silver salts and examples of other organic silver salts have been described in, for example, U.S. Pat. Nos. 3,457,075, 3,549,379, 3,785,830, 3,933,507 and 4,009,039, British Pat. 1,230,642 and Japanese patent applications (OPI) No. 93139/75, 99719/75, 141222/77 and 36224/78. In the present invention, the component (b) used can be suitably selected from these known organic silver salts. For example, in case of using a silver halide or a silver dye sensitive complex as a photocatalyst, substances comparatively stable to light are selected from the above-described known organic silver salts. Preferred examples of such substances include silver salts of higher aliphatic carboxylic acids having 10 to 40 carbon atoms, particularly 18 to 33 carbon atoms, examples of which include silver laurate, silver myristate, silver palmitate, silver stearate, silver arachidate, silver behenate, silver lignoglycerate, silver pentacosanoate, silver cerotate, silver heptacosanoate, silver montanate, silver melissate and silver laccerate, etc.

Synthesis of these organic silver salts is carried out by various known processes described in, for example, U.S. Pat. Nos. 3,457,075, 3,458,544, 3,700,458, 3,839,049 and 3,960,908, British Pat. No. 1,173,426 and Japanese patent applications (OPI) 52626/74, 122011/76 and 14122/77. It is particularly preferred that formation of organic silver salts be carried out in the presence of polymers described in U.S. Pat. No. 3,700,458 and Japanese patent application (OPI) 32015/78, or metal containing compounds described in U.S. Pat. No. 3,887,597 and Japanese patent application (OPI) 13224/74, because the particle form, the particle size and/or photographic properties of the organic silver salts are improved. A preferred amount of these coexisting components is the range of about 0.1 to 1000 g and particularly about 1 to 500 g, per mol of yielded organic silver salt in case of polymers and about $10^{-6}$ to $10^{-1}$ mols in case of metal containing compounds.

Of the organic silver salts prepared as described above, those having a particle size of about 0.01 to 10 microns, particularly about 0.1 to 5 microns of the length are preferred.

The organic silver salts of component (b) in the present invention are used in an amount of about 0.1 g to 4 g, preferably, about 0.2 g to 2.5 g calculated as silver based on 1 $m^2$ of support. The amount in this range is sufficient to afford a suitable image density. If they are used in an amount lower than this range, the image density becomes insufficient. On the other hand, the image density is not improved but the cost increases if they are used in an amount of larger than this range.

The photocaralyst, component (c), used in the present invention is a compound which changes into a substance catalyzing the silver (image) formation reaction of the organic silver salt with the reducing agent upon heating to 80° C. or more, or a compound having the ability to release such a substance when subjected to application of electromagnetic radiation.

As the photocatalyst, there are inorganic photoconductive substances such as zinc oxide or titanium oxide, etc., salts of a heavy metal and diazosulfonic acid or sulfinic acid described in U.S. Pat. No. 3,152,904; and/or photosensitive complexes of silver and dyes described in Japanese Pat. Publication No. 25498/74, Japanese patent application No. 4728/71 or U.S. Pat. No. 3,933,507, and photosensitive silver salts such as photosensitive silver halide described in U.S. Pat. No. 3,457,075, etc. They are used, in general, in an amount of about 0.001 mols to 10 mols and preferably about 0.01 mols to 1 mol per mol of the organic silver salt.

Among these photocatalysts, the most preferred one used for the present invention is a photosensitive silver halide such as silver chloride, silver bromide, silver iodide, silver chlorobromoiodide, silver chlorobromide, silver chloroiodide, silver iodobromide or a mixture thereof. A preferred particle size of the photosensitive silver halide is about 0.001 to 2 microns and, particularly, about 0.01 to 0.5 microns. The amount used is about 0.001 to 0.7 mols and, preferably, about 0.01 to 0.5 mols per mol of the organic silver salt.

The photosensitive silver halide can be introduced into the composition used in the present invention by previously preparing an emulsion such as a Lipman emulsion, an ammonia process emulsion or an emulsion aged with thiocyanate or thioether by a suitable process known in the photographic field such as a single jet process or a double jet process, etc., and mixing with other components of the present invention. In order to obtain sufficient contact of the organic silver salt with the photosensitive silver halide in this case, it is possible to apply various means such as means of using other polymers than gelatine, such as polyvinyl acetals described in U.S. Pat. Nos. 3,706,564, 3,706,565, 3,713,833 and 3,748,143 and British Patent 1,362,970 as the protective polymer for preparing the photosensitive silver halide emulsion; means of carrying out enzymatic decomposition of gelatine in the photosensitive silver halide emulsion as described in British Pat. No. 1,354,186; or means of preparing photosensitive silver halide particles in the presence of a surface active agent without using a protective polymer as described in U.S. Pat. No. 4,076,539.

The photosensitive silver halide used in the present invention can be produced simultaneously with formation of the organic silver salt by pouring silver ion solution into a solution mixture comprising a halogenating agent and an organic silver salt forming component as described in British Pat. No. 1,447,454.

Further, as another process, a solution or a dispersion of a previously prepared organic silver salt or a sheet material containing the organic silver salt may be subjected to reaction with a photosensitive silver halide forming component to change a part of the organic silver salt into photosensitive silver halide. The thus formed photosensitive silver halide contacts effectively with the organic silver salt to show a preferred function.

The above-described photosensitive silver halide forming component is a compound capable of forming photosensitive silver halide by reacting with the organic silver salt, which can be discriminated by the following simple test. Namely, after a compound to be tested is mixed with an organic silver salt and, if necessary, heated, characteristic refraction peaks are examined by an X-ray refraction method. As effective photosensitive silver halide forming components ascertained by the above-described test, there are inorganic halides, onium halides, halogenated hydrocarbons, N-halogen compounds and other halogen contained compounds. Examples of them have been described in U.S. Pat. Nos. 4,009,039, 3,457,075 and 4,003,749, British Pat. Nos. 1,498,956 and 1,498,956, and Japanese patent applications (OPI) 27027/78 and 25420/78, and some examples of them are described in the following.

(1) Inorganic halides: For example, halides represented by MX (where M represents H, $NH_4$ or a metal atom, X represents Cl, Br or I, and n is 1 when M is H or $NH_4$ or represents a valence of a metal atom when M is the metal atom. The metal atom includes lithium, sodium, potassium, cesium, magnesium, calcium, strontium, barium, zinc, cadmium, mercury, tin antimony, chromium, manganese, iron, cobalt, nickel, rhodium and cerium, etc.).

(2) Onium halides: For example, quaternary ammonium halides such as trimethylphenylammonium bromide, cetylethyldimethylammonium bromide or trimethylbenzylammonium bromide; quaternary phosphonium halides such as tetraethylphosphonium bromide; and tertiary sulfonium halides such as trimethylsulfonium iodide, etc.

(3) Halogenated hydrocarbons: For example, iodoform, bromoform, carbon tetrabromide and 2-bromo-2-methylpropane, etc.

(4) N-halogen compounds: For example, N-chlorosuccinimide, N-bromosuccinimide, N-bromophthalimide, N-bromoacetamide, N-iodosuccinimide, N-bromophthalazone, N-bromooxazolinone, N-chlorophthalazone, N-bromoacetanilide, N,N-dibromobenzenesulfonamide, N-bromo-N-methylbenzene sulfonamide, 1,3-dibromo-4,4-dimethylhydantoin and N-bromourazol, etc.

(5) Other halogen contained compounds: For example, triphenylmethyl chloride, triphenylmethyl bromide, 2-bromoacetic acid, 2-bromoethanol and dichlorobenzophenone, etc.

These photosensitive silver halide forming components are used in a stoichiometrically small amount to the organic silver salt. Generally, they are used in an amount of about 0.001 to 0.7 mols and preferably about 0.01 to 0.5 mols per mol of the organic silver salt. Two or more kinds of photosensitive silver halide forming components may be used together in amounts in the above-described range. Although conditions of the process for converting a part of the organic silver salt into the photosensitive silver halide using the photosensitive silver halide forming component, such as reaction temperature, reaction time or reaction pressure, etc. can be suitably selected from wide ranges according to the purpose of the products, it is generally preferred that the reaction temperature be about −20° C. to 70° C., the reaction time about 0.1 seconds to 72 hours and the reaction pressure be atmospheric pressure. Further, it is preferred that the reaction is carried out in the presence of a polymer used as a binder described hereinafter. An amount of the polymer used in this case is in the range of about 0.01 to 100 parts by weight and preferably about 0.1 to 10 parts by weight based on 1 part by weight of the organic silver salt.

The photosensitive silver halide prepared by the above-described various processes can be chemically sensitized with, for example, sulfur containing compounds, gold compounds, platinum compounds, palladium compounds, silver compounds, tin compounds, chromium compounds or a combination of them. The procedure of chemical sensitization has been described in, for example, U.S. Pat. No. 4,036,650, British Pat. No. 1,518,850 and Japanese Patent Applications (OPI) 22430/76, 78319/76 and 81124/76. In case of converting a part of the organic silver salt into the photosensitive silver salt using the photosensitive silver halide forming component, the sensitization can be carried out by coexistence of an amide compound having a low molecular weight as described in U.S. Pat. No. 3,980,482.

The photocatalyst, component (c), particularly, photosensitive silver halide, can be spectrally sensitized by various known dyes. As effective optical sensitization dyes, there are, for example, cyanine, merocyanine, rhodacyanine, complex (3 nuclear or 4 nuclear) cyanine or merocyanine, holopolar cyanine, styryl, hemicyanine, oxonole, hemioxonole and xanthene dyes. Among cyanine dyes, those having a basic nucleus such as a thiazoline nucleus, an oxazoline nucleus, a pyrroline nucleus, an oxazole nucleus, a thiazole nucleus, a selenazole nucleus or an imidazole nucleus are preferred to use. Among the merocyanine dyes, those having an acid nucleus such as a thiohydantoin nucleus, a rhodanine nucleus, an oxazolidinedione nucleus, a thiazolidinedione nucleus, a barbituric acid nucleus, a thiazolinone nucleus, a malonitrile nucleus or pyrazolone nucleus together with the above-described basic nucleus are preferred to use. Among the above-described dyes, cyanine and merocyanine dyes having an imino group or carboxyl group are particularly effective. In concrete, the dye is selected suitably from known dyes described in, for example, U.S. Pat. Nos. 3,76.279, 3,719,495 and 3,877,943, British Pat. Nos. 1,466,201 1,469,117 and 1,422,057 and Japanese patent application Nos. (OPI) 27924/76 and 156424/75, which is processed so as to be positioned near the photocatalyst according to the above-described known process. These optical sensitization dyes are used in an amount of the range of about $10^{-4}$ mols to about 1 mol per mol of the photocatalyst of the component (c).

The reducing agent, component (d), used in the present invention is a substance which reduces the organic silver salt by reacting therewith when heated to 80° C. or more in the presence of the exposed photocatalyst and functions as an oxidation reduction image forming component together with the organic silver salt in the heat-developable photosensitive material. A suitable reducing agent is determined based on the kind or properties of organic silver salt used. For example, a reducing agent having a high reduction ability is suitable for organic silver salts which are difficult to reduce, while a reducing agent haveing low reduction ability is suitable for organic silver salts which are easily reduced.

Generally known reducing agents used in the heat-developable photosensitive materials include monophenols, polyphenols having two or more phenol groups, mononaphthols, bisnaphthols, polyhydroxybenzenes having two or more hydroxyl groups, polyhydroxynaphthalenes having two or more hydroxyl groups, ascorbic acids, 3-pyrazolidones, pyrazoline-5-ones, pyrazolones, phenylenediamines, hydroxylamines, hydroquinone monoethers hydroxamic acids, hydrazides, amidoximes and N-hydroxyureas, etc. In greater detail, there are reducing agents described in, for example, U.S. Pat. Nos. 3,615,533, 3,679,426, 3,672,904, 3,751,252, 3,782,949, 3,801,321, 3,794,949, 3,801,321, 3,794,488, 3,893,863, 3,887,376 3,770,448, 3,819,382, 3,773,512, 3,928,686, 3,839,048, 3,887,378, 4,009,039 and 4,021,249, British Pat. No. 1,486,148 or Belgian Pat. No. 786,086, Japanese patent application Nos. (OPI) 36143/75, 36110/75, 116023/75, 99719/75, 51933/76, 23721/76 and 84727/77 and Japanese patent publication No. 35851/76. The component (d) of the present invention can be suitably selected from these known reducing agents. The most convenient method for selecting the reducing agent is believed to be to produce practically a heat-developable photosensitive material using the reducing agent, and examine the photographic properties of the heat-developable photosensitive material obtained, i.e., by test samples.

Among the above-described reducing agents, preferred reducing agents when using silver salts of aliphatic carboxylic acids as the organic silver salt include polyphenols in which two or more phenol groups are connected by an alkylene group or sulfur and, particularly, polyphenols in which two or more phenol groups having an alkyl group (for example, methyl group, ethyl group, propyl group, t-butyl group or cyclohexyl group, etc.) or an acyl group (for example, acetyl group or propionyl group, etc.) on at least one of two positions adjacent to the hydroxyl group on the phenol group are connected by an alkylene group or sulfur (for example, 1,1-bis-(2-hydroxy-3,5-dimethylphenyl)-3,5,5-trimethylhexane, 1,1-bis-(2-hydroxy-3-t-butyl-5-methylphenyl)methane, 1,1-bis-(2-hydroxy-3,5-di-t-butylphenyl)methane, 2,6-methylenebis-(2-hydroxy-3-t-butyl-5-methylphenyl)-4-methylphenol, 6,6'-benzylidene-bis-(2,4-di-t-butylphenol), 6,6'-benzylidene-bis-(2-t-butyl-4-methylphenol), 6,6'-benzylidene-bis-(2,4-dimethylphenol), 1,1-bis-(2-hydroxy-3,5-dimethylphenyl)-2-methylpropane, 1,1,5,5-tetrakis-(2-hydroxy-3,5-dimethylphenyl)-2,4-ethylpentane, 2,2-bis-(4-hydroxy-3,5-dimethyl)propane and 2,2-bis-(4-hydroxy-3,5-di-t-butylphenyl)propane, etc. described in U.S. Pat. Nos. 3,589,903 and 4,021,249, British Pat. No. 1,486,148, Japanese Patent Applications (OPI) 51933/76, 36110/75, 116023/75 and 84727/77 and Japanese Patent Publication 35727/76; bis-$\beta$-naphthols described in U.S. Pat. 3,672,904 (for example, 2,2'-dihydroxy-1,1'-binaphthyl, 6,6'-dibromo-2,2'-dihydroxy-1,1'-binaphthyl, 6,6'-dinitro-2,2'-dihydroxyl,1'-binaphthyl, bis-(2-hydroxy-1-naphthyl)-methane and 4,4'-dimethoxy-1,1'-dihydroxy-2,2'-binaphthyl, etc.); and sulfonamidophenols or sulfonamidonaphthols described in U.S. Pat. No. 3,801,321 (for example, 4-benzenesulfonamidophenol, 2-benzenesulfonamidophenol, 2,6-di-chloro-4-benzenesulfonamidophenol and 4-benzenesulfonamidonaphthol, etc.).

The amount of the reducing agent used in the present invention varies according to the kins of the organic silver salt or the reducing agent or other additives, but it is generally preferred to be in the range of about 0.05 to 10 mols and preferably about 0.1 to 3 mols per mol of the organic silver salt. Further, within this range, two or more of the above-described reducing agents may be used together.

Although each of components (b), (c) and (d) of the present invention may be comprised in a separate sensitive layer, it is preferred that said components (b) and (c) be comprised in the same sensitive layer. Most preferably, all the components (b), (c) and (d) are comprised in the same sensitive layer.

It is preferred that an additive called a toner, a tone activator or an activator toner (collectively referred to as toner, hereinafter) is used together with the above-described components. The toner has a function of tickening or, particularly, blackening the formed image by taking part in an oxidation-reduction silver (image) forming reaction of the organic silver salt with the reducing agent. As the toner, a number of compounds are already known and most of them contain an imino group, a mercapto group or a thione group. The toner is suitably selected according to the kind of the organic silver salt and the reducing agent used. As the toner which shows a preferable toning effect in the present invention, there are heterocyclic compounds having an imino group, such as phthalazinones described in U.S. Pat. Nos. 3,152,904, 3,844,797 and 4,076,534 (for example, phthalazinone, 2-acetylphthalazinone and 2-carbamoylphthalazinone, etc.), 2-pyrazoline-5-ones (for example, 3-methyl-2-pyrazoline-5-one, etc.) and quinazolines (for example, quinazoline and 4-methylquinazoline, etc.) described in U.S. Pat. No. 3,846,136, pyrimidines (for example, 6-methyl-2,4-dihydroxypyrimidine, etc.) and 1,2,5-triazines (for example, 3-methyl-4,6-dihydroxy-1,2,5-triazine, etc.) described in U.S. Pat. No. 4,030,930, phthalazinediones (for example, phthalazinedione, etc.) described in Japanese Patent Publication 36774/78, and cyclic imides (for example, succinimides, phthalimides and urazols described in U.S. Patent 3,846,136 and Japanese patent application No. (OPI) 55115/78, benzoxazinediones described in U.S. Pat. Nos. 3,951,660 and 3,885,967, benzothiazinediones described in Japanese patent application (OPI) 76020/78 and naphthalimides described in U.S. Pat. No. 3,782,941). Two or more of these toners may be used together. For example, it is possible to prevent deterioration of the toning effect caused by storage under a high temperature and a high humidity by using phthalazinone together with benzoxazinediones, benzothiazinediones or phthalimides as described in Japanese patent application Nos. (OPI) 1020/78 and 55115/78.

Further, as described in U.S. Pat. No. 3,847,612 and 3,994,732, phthalic acid, naphthoic acid or phthalamic acid can be used together with phthalazones or imidazoles as a toner.

In the case of using the toner, a preferred amount thereof is in the range of about 0.0001 to 2 mols and particularly about 0.0005 to 1 mol per mol of the organic silver salt.

Compounds which are effective for preventing discoloration by light of the processed materials known in this field may be used together with each component of the heat-developable photosensitive materials of the present invention. For example, there are stabilizer precursors such as azole thioether or azole thiones as described in U.S. Patent 3,839,041, tetrazolyl compounds and precursors thereof as described in U.S. Pat. No. 3,700,457, halogen containing compounds as described in U.S. Pat. Nos. 3,707,377, 3,874,946 and 3,955,982 and sulfur as described in Japanese Patent Publication 26019/76, which may be used together.

Further, it is possible to use compounds which are effective for preventing fog formed in unexposed areas upon thermal development (referred to as thermal fog). As the thermal antifogging agent, a number of compounds are known already. For example, there are mercury compounds described in U.S. Pat. No. 3,589,903, N-halogen compounds described in U.S. Pat. No. 3,957,493, benzenethiosulfonic acid described in Japanese Patent Application (OPI) 78227/76, sulfinic acids described in Japanese Pat. application (OPI) 122430/76, cerium compounds described in Japanese patent application (OPI) 24520/77, and thermal antifogging agents described in Japanese Patent application Nos. (OPI) 101019/75, 116024/75, 123331/75, 13442/75 47419/76, 42529/76, 51323/76, 57435/76, 104338/76, 32015/78, 22431/76, 54428/76, 75433/76, 122430/76, 1020/78, 19825/78 and 28417/78, which may be used alone or together.

Each component used in the present invention is dispersed in at least one colloid of the binder, component (a). The preferred binder includes hydrophobic high molecular materials, but, if necessary, hydrophobic high molecular materials may be used alone or together. The high molecular materials used as the binder preferably form a transparent or translucent and colorless, white or lightly colored layer when applied. Examples include proteins such as gelatin, polysaccharides such as cellulose derivatives or dextran, etc., natural high molecular materials such as gum arabic, and synthetic high molecular materials such as described in U.S. Pat. No. 4,009,039, and Japanese patent application Nos. (OPI) 126408/75, 29126/76, 19529/76 and 84443/74. Among them, polyvinyl butyral, polyvinyl acetate, ethylcellulose, vinylidene chloride-vinyl chloride copolymer, polymethyl methacrylate, vinyl chloride-vinyl acetate copolymer, cellulose acetate butyrate, gelatine and polyvinyl alcohol are particularly preferred. If necessary, two or more of these high molecular materials may be used together. The most preferred binder for the sensitive layer is polyvinyl butyral. These high molecular materials are used in an amount sufficient to support the components dispersed therein, namely, an amount effective as a binder. The amount can be suitably decided by persons skilled in the art. As an example, in the case of dispersing at least an organic silver salt, the binder is used in an amount of about 10:1 to 1:10 and, particularly, about 4:1 to 1:4 in ratio by weight to the organic silver salt.

The composition comprising the components (a) to (d) of the present invention is applied to various supports selected from a variety of materials to form a sensitive layer or two or more sensitive layers by dividing it. As raw materials, there are various high molecular materials, glass, wool cloth, cotton cloth, paper and metal (for example, aluminium) etc., but those capable of forming elastic sheets or rolls are preferred form the viewpoint of treatment as information recording materials. Accordingly, it is particularly preferred to use as the support in the present invention plastic films (for example, cellulose acetate films, polyester films, polyethylene terephthalate films, polyamide films, polyimide films, polyimide films, triacetate films and polycarbonate films) or paper (photographic support paper, printing paper such as coated paper or art paper, baryta paper, resin coated paper, paper sized with polysaccharide as described in Belgian Pat. No. 784,615, pigmented paper containing a pigment such as titanium dioxide and paper sized with polyvinyl alcohol besides conventional paper.

The heat-developable photosensitive materials of the present invention include heat-developable photosensitive materials having an undercoating layer between the support and the sensitive layer. Though polymers for the undercoating layer are not especially restricted, it is preferred to use vinyl chloride type copolymers or vinylidene chloride type copolymers described in Japanese Patent Application 87721/78, because green storage stability under a high temperature and a high humidity is improved. When an undercoating layer composed of these copolymers is provided, the problem of generating bubbles in coating films (upon the step of thermal development) can be completely prevented by adding component (e) of the present invention to the undercoating layer or the sensitive layer laid thereon.

As the vinyl chloride type copolymers and the vinylidene chloride type copolymers composing the undercoating layer, there are various materials. Namely, examples include copolymers of vinyl ester and vinyl chloride, copolymers of acrylic acid ester and vinyl chloride, copolymers of maleic acid ester and vinyl chloride, copolymers of fumaric acid ester and vinyl chloride, copolymers of acrylonitrile and vinyl chloride, copolymers of vinyl alkyl ether and vinyl chloride, copolymers of vinyl chloride and vinylidene chloride, copolymers of acrylonitrile and vinylidene chloride and copolymers of vinyl ester and vinylidene chloride, etc.

As acids composing the vinyl ester, there are carboxylic acids and sulfonic acids having 1 to 22 carbon atoms. Examples of the vinyl ester include vinyl acetate, vinyl stearate, vinyl butyrate, vinyl propionate, vinyl diethylphosphonoacetate and butyl vinylsulfonate, etc. Further, a part of the vinyl ester may be hydrolyzed.

As alcohols composing the acrylic acid ester, maleic acid ester and fumaric acid ester, there are alcohols having 1 to 22 carbon atoms. Further, a part of these esters may be hydrolyzed. Examples of the alcohol include methanol, ethanol, propanol, isopropanol, butanol, isobutanol, lauryl alcohol, stearyl alcohol and 2,3-epoxypropanol, etc.

Materials comprising various kinds of the above-described monomers as a combination and partially hydrolyzed products are also useful.

The ratio of vinyl chloride or vinylidene chloride to the other monomer can vary in a wide range. It is preferred that the ratio of vinyl chloride or vinylidene chloride is 50% (molar ratio) or more. It is particularly preferred that the ratio of vinyl chloride or vinylidene chloride is 70 to 98% (molar ratio).

In case of using the copolymer of vinyl chloride and vinylidene chloride, it is preferred that the molar ratio of vinylidene chloride is 50 to 98%.

The degree of polymerization can be varied in a wide range. Generally, at least one copolymer having a degree of polymerization of 30 or more selected from vinyl chloride type copolymers and vinylidene type copolymers is used. Preferably, at least one copolymer having a degree of polymerization of 50 to 50000 selected from vinyl chloride type copolymers and vinylidene type copolymers is used.

Other examples of the vinyl chloride type copolymers and vinylidene type copolymers include the following copolymers: Vinyl acetate-vinyl chloride copolymer, vinyl acetate-vinyl alcohol-vinyl chloride copolymer, vinyl acetate-maleic acid-vinyl chloride copolymer, vinyl stearate-vinyl chloride copolymer, vinyl butyrate-vinyl chloride copolymer, vinyl propionate-vinyl chloride copolymer, vinyl diethylsulfone acetate-vinyl chloride copolymer, butyl vinylsulfonate-vinyl chloride copolymer, methyl acrylate-vinyl chloride copolymer, ethyl acrylate-vinyl chloride copolymer, lauryl acrylate-vinyl chloride copolymer, 2,3-epoxypropyl methacrylate-vinyl chloride copolymer, diethyl fumarate-vinyl chloride copolymer, diethylmaleate-vinyl chloride copolymer, dibutyl maleate-vinyl chloride copolymer, vinyl isobutyl ether-vinyl chloride copolymer, allyl 2,3-epoxypropyl ether-vinyl chloride copolymer, chlorobutadiene-vinyl chloride copolymer, methyl acrylate-vinylidene chloride copolymer and ethyl methacrylate-vinylidene chloride copolymer, etc.

The polymers for the undercoating layer are preferably used in an amount of about 0.1 to 10 g and particularly 0.2 to 3 g per 1 $m^2$ of the support.

Further, the heat-developable photosensitive materials include heat-developable photosensitive materials having a top coating layer provided on the above-described sensitive layer. In this case, poor adhesion of the top coating layer to the sensitive layer originated from a difference of polarity of polymers can be improved by presence of the component (e) of the present invention.

Although the polymers suitable for use in the top coating layer are not particularly restricted, it is possible to use polyvinyl acetal, polyvinyl acetate, polyvinyl acetate alcohol, vinyl acetate copolymer, polyvinyl alcohol, polyvinyl alkyl ether, chlorinated polyethylene, polyvinyl chloride, polyvinylidene chloride, vinyl chloride copolymer, polymethyl acrylate, polyisobutyl acrylate, polymethyl methacrylate, polyurethane, cellulose acetate, cellulose acetate butyrate, cellulose propionate, carboxymethylcellulose and gelatine, etc. These polymers are applied to sensitive layer by dissolving in a suitable solvent. In case that a solvent similar to that for the sensitive layer is used for the top coating layer, multilayer simultaneous application can be carried out. Of course, successive application can be carried as well.

In the heat-developable photosensitive materials of the present invention, it is possible to provide various kinds of other auxiliary layers, for example, a vacuum evaporation metal layer described in U.S. Pat. No. 3,748,137, a backing layer described in British Pat. No. 1,507,991 and Japanese patent application (OPI) 43130/76 and 129220/76 and a backing layer containing a magnetic material described in Japanese patent application (OPI) 136099/75 as well as an antistatic layer.

The layer containing each component of the present invention or each auxiliary layer may contain additives known in the field of heat-developable photosensitive material, for example, plasticizers, matting agents, surface active agents, sensitizers, whitening agents, light absorbing agents, filter dyes, antihalation dyes, color couplers, hardening agents, lubricants, development accelerators and stabilizers, etc. Concrete names of these additives and embodiments of using them have been described in Product Licensing Index, Vol. 92 (Dec. 1971) No. 9232, on and after page 107; Japanese patent applications (OPI) Nos. 33615/78, 119623/75, 57619/75 and 27923/76 and U.S. Pat. Nos. 3,769,019, 3,821,001, 3,667,959, 3,871,887, 3,885,965, 4,021,250, 4,036,650, 3,531,286 and 3,764,328.

A process for preparing the heat-developable photosensitive materials of the present invention is described roughly as follows. Namely, the organic silver salt produced by utilizing one of known processes is mixed with the photocatalyst after washing, if necessary, with water or alcohol to produce an intimate mixture. In another process, the photocatalyst may be formed simultaneously with the organic silver salt. As the most preferred process, there is a process which comprises converting a part of the organic silver salt into silver halide by the silver halide forming component. In case of using a sensitizing dye, the sensitizing dye is preferably added as a solution to the mixture after preparation of said mixture as described above. The mixture of the organic silver salt and the photocatalyst is suitably prepared as a polymer dispersion where they are dispersed in a solution of a high molecular material which functions afterwards as a binder. The polymer may be added at any stage such as preparation of the organic silver salt, blending the photocatalyst or preparation of the photocatalyst, etc. This dispersion of the organic silver salt and the photocatalyst may be applied to the support to form a layer and the other components of the present invention are added to another layer provided on said layer. It is however preferred that other components, at least the reducing agent and/or the component (e) of the present invention, are added to the above-described polymer dispersion of the organic silver salt and the photocatalyst and the resultant heat-developable photosensitive composition is applied to the base to form a layer. In order to carry out application of the composition, various known coating methods, such as dip coating, air-knife coating, curtain coating or hopper coating, etc., can be utilized. Further, if desired, the auxiliary layers, such as the undercoating layer and/or the top coating layer, etc., are applied prior to, simultaneously with or after application of the above-described composition. Component (e) of the present invention may be added to a coating solution for the undercoating layer and/or a coating solution for the top coating layer.

The component (e) of the present invention makes possible simultaneous application of the sensitive layer and the auxiliary layers. When the heat-developable photosensitive material is produced by applying two of the photosensitive layer and the top coating layer at the same time using the same kind of binder (particularly, polyvinyl butyral), a particularly excellent effect of improving film properties can be obtained. The multilayer simultaneous application can be practised using the apparatus described in, for example, U.S. Pat. No. 2,761,791.

Any solvent may be used for the coating solutions, and non-combustible solvents described in British Pat. No. 1,422,145 can also be used.

If desired, printing is carried out on the surface or the back of the support or on the layer applied to the base, by which they can be applied for tickets (commutation tickets), postcards or other papers.

The resultant heat-developable photosensitive material is imagewise exposed to light after being cut to a suitable size. If desired, it may be previously heated (80° C. to 140° C.) before exposure. As a light source suitable for image exposure, there are various light sources such as fluorescent lamps for copying used for exposure of diazosensitive materials, mercury lamps, iodine lamps, xenon lamps, CRT light sources and laser light sources, etc. As an original, not only line drawings such as a draft, etc. but also photographic images having gradation may be used. Further, it is possible to take a photograph of a portrait or a landscape using a camera. The printing may be carried out by contact printing in close contact with the original, by reflection printing or by enlargement printing. The quantity of exposure varies according to the sensitive material. But it is necessary that it is about 1 lux-second in case of a high speed sensitive material and about $10^3$ lux-second in case of a low-speed sensitive material. The sensitive material exposed imagewise to light is then developed by only heating (about 80° C. or more and preferably about 100° C. to about 150° C.). The heating time is suitably controlled in the range, for example, of 1 second to 60 seconds depending on the heating temperature. Generally, about 5 seconds to about 40 seconds at 120° C., about 2 seconds to about 20 seconds at 130° C. and about 1 second to about 10 seconds at 140° C. are preferred. As heating means, there are various ones. For example, the sensitive material may be brought into contact with a heated plate or brought into contact with a heated drum and, if desired, it may be passed through a heating space. Further, it may be heated by high-frequency heating or by a laser beam.

The heat-developable photosensitive materials of the present invention are very useful, because film strength upon thermal development is increased as a function of the polyisocyanate, component (e) and, consequently, troubles with film properties upon thermal development can be removed. Namely, according to the present invention, it becomes possible, for the first time, to produce a sensitive layer having sufficient strength which withstands the troubles originated from mechanical or thermal causes. Therefore, it is not necessary to select a heat-resisting binder in case of providing the top coating layer and, consequently, a selection range for the binder expands and restriction on production is reduced. Furthermore, according to the present invention, it becomes possible to provide the top coating layer effective for increasing transparency of the sensitive layer without having separation from the sensitive layer and to provide the undercoating layer effective for improving green storage stability under high temperature and high humidity without the separation from the sensitive layer and generation of bubbles, and thus heat-developable photosensitive materials having further improved properties can be obtained.

Moreover, the production cost can be reduced and the production rate can be increased by the present invention, because heat-developable photosensitive materials having excellent film properties can be produced without deterioration of the film properties, when the multilayer simultaneous application (particularly, for the sensitive layer and the top coating layer) is carried out using the same binder (particularly, polyvinyl butyral), and thus the present invention is very useful.

Below, the present invention is illustrated in greater detail with reference to some specific examples.

EXAMPLE 1

Preparation of coating solution for sensitive layer 34 g of behenic acid was mixed with 500 ml of water and heated to 85° C. to dissolve the behenic acid. To the solution, an aqueous solution of sodium hydroxide (NaOH 2.0g+water 500 ml) (25° C.) was added over 3 minutes with stirring at 1800 rpm to produce a mixture of sodium behenate and behenic acid. The temperature was reduced from 85° C. to 40° C. while continuing the stirring.

To the mixture, an aqueous solution of silver nitrate ($AgNO_3$:8.5 g+water 50 ml) (30° C.) was added within 3 minutes with stirring, and the stirring was continued. 200 ml of isoamyl acetate was then added to the mixture and the resulting behenic acid-silver behenate mixture was recovered. It was then dispersed in a solution of polyvinyl butyral in isopropanol (polyvinyl butyral:25 g+isopropanol:200 ml) using a homogenizer (25° C., 3000 rpm, 30 minutes) to produce a polymer dispersion of behenic acid-silver behenate.

The resultant dispersion was then kept at 50° C. and a solution of N-bromosuccinimide in acetone (N-bromosuccinimide:0.7 g+acetone:500 ml) (25° C.) was added thereto over 40 minutes with stirring at 500 rpm. The stirring was continued for 60 minutes to produce a polymer dispersion of silver bromide-behenic acid-silver behenate (average particle size of silver bromide was 0.06μ).

1/12 by volume (1/240 by mol) of this polymer dispersion of silver bromide-behenic acid-silver behenate was removed and kept at 30° C. To the solution, the following components were added at intervals of 5 minutes with stirring at 200 rpm to prepare a coating solution for a sensitive layer.

| | | |
|---|---|---|
| (i) | Merocyanine dye having the following formula (sensitizing dye) (0.025 wt % solution in methylcellosolve) | 2 ml |
| | 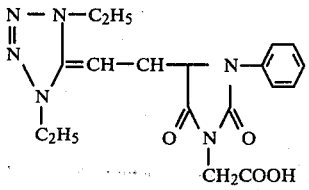 | |
| (ii) | Sodium benzenethiosulfonate (antifogging agent) (0.01 wt % solution in methanol) | 2 ml |
| (iii) | m-Nitrobenzoic acid (antifogging agent) (0.5 wt % solution in ethanol) | 2 ml |
| (iv) | Phthalazinone (toner) (4.5 wt % solution in methylcellosolve) | 5 ml |
| (v) | Phthalimide (toner) (4 wt % solution of methylcellosolve) | 10 ml |
| (vi) | o-Bisphenol having the following formula (reducing agent) (10 wt % solution in acetone) | 10 ml |
| | 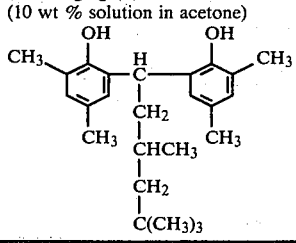 | |

Application

The coating solution for the sensitive layer produced as described above was applied to paper 64 g in weight previously sized with polyvinyl alcohol, so as to be 0.3 g/m of the silver content and dried to produce heat-developable photosensitive materials. Heat-developable photosensitive material (A) was produced by adding a solution of an adduct of 3 mols of hexamethylenediisocyanate and 1 mol of trimethylol propane in methyl ethyl ketone (10 wt %) continuously at a rate of 60 ml per 1000 ml of the coating solution for the sensitive layer just before application, while heat-developable photosensitive material (B) was produced by applying only the coating solution for the sensitive layer without adding the above-described adduct.

Both samples (A) and (B) were exposed to light at 10000 CMS through a stepwedge and developed subsequently for 3 seconds by pressing against a heat roll heated to 130° C. Photographic properties and the quality of film of both samples were examined. The results obtained are shown in Table 1.

TABLE 1

| Sample | Photographic Property Fog | D max | Relative Sensitivity* | Film Quality |
|---|---|---|---|---|
| (A) (Present Invention) | 0.07 | 1.37 | 82 | Abnormality is not observed. |
| (B) (Comparison) | 0.08 | 1.40 | 100 | A part of the coating layer adhered to the roll, and shear of images occurred. |

*Relative value based on the sensitivity of (B) (inverse number of exposure necessary to give the density of fog + 0.1) being 100.

It is understood from Table 1 that deterioration of film quality upon thermal development can be prevented by adding the adduct of polyisocyanate and the adduct of polyisocyanate does not have a bad influence upon the photographic properties except that the sensitivity is slightly reduced (but the reduction of sensitivity to this degree is not so significant).

EXAMPLE 2

A solution of cellulose diacetate in acetone (2.5 wt%) was applied to the sensitive layer (not containing polyisocyanate) of the heat-developable photosensitive material produced in Example 1 so as to have 1 g/m$^2$ of solid content, and dried to produce heat-developable photosensitive materials having a top coating layer. In this case, the heat-developable photosensitive material (C) was produced by applying a coating solution which was prepared by dissolving 6 parts of a solution of an adduct composed of 3 mols of tolylenediisocyanate and 1 mol of trimethylol propane (Trade name: Colonate, produced by Nippon Polyurethane Ind. Co.) in butyl acetate (10%) in 100 parts of the above-described coating solution for the top coating layer, while the heat-developable photosensitive material (D) was produced by applying only the coating solution for the top coating solution without adding the above-described adduct.

These both samples (C) and (D) were exposed to light in the same manner as in Example 1 and they were then developed by contacting their packs with a hot plate heated to 130° C. for 8 seconds. After development, a friction pull test was carried out by allowing an adhesive tape to adhere to the surface of the top coating layer of each sample and stripping the tape. As a result, the sensitive layer and the top coating layer were separated at the interface thereof in case of the sample (D), while such separation at the interface did not occur in case of the sample (C).

On the other hand, both samples (C) and (D) were exposed to light and developed by a heat roll in the same manner as in Example 1. When the quality of the film was examined, a shear of images was observed in the sample (D), while such shear was not observed in the sample (C) containing the isocyanate adduct.

As the result, it was understood that the adduct of polyisocyanate of the present invention prevented deterioration due to adhesion caused by the difference of polarity between the sensitive layer (polyvinyl butyral) and the top coating layer (cellulose diacetate) and, further, prevented the shear of images caused by development by means of the heat roll.

EXAMPLE 3

Samples (E) and (F) corresponding to Samples (C) and (D) in Example 2 were produced by the same manner except that a solution of vinyl chloride-vinyl acetate copolymer (Trade name: MPR-TA, produced by Nisshin Kagaku Co.) in methyl ethyl ketone (3 wt%) was used as a coating solution for the top coating layer and applied so as to have 1.2 g/m$^2$ application amount. A friction pull test and a development test by a heat roll were carried out in the same manner as in Example 2. As the result, it was understood that, in the sample (E) having a top coating layer containing the adduct of tolylenediisocyanate and trimethylol propane, the interfacial separation and the shear of images observed in the Sample (F), which did not contain the adduct, did not occur. Consequently, the polyisocyanate of the present invention exhibited its effect regardless of the polymer in the top coating layer.

In Examples 2 and 3, it was ascertained that properties of samples (C) and (E) containing the adduct of tolylenediisocyanate and trimethylol propane were equal to those of samples (D) and (F) which did not contain the adduct, by which it was understood that the adduct did not have a bad influence upon the photographic properties.

EXAMPLE 4

Samples (G) to (J) were produced in the same manner as in Example 2, except that paper having an undercoating layer shown in Table 2 (coating amount at dryness: about 1.5 g/m$^2$) was used as a support in case of producing Sample (D) (having a sensitive layer and a top coating layer composed of cellulose idacetate which did not contain polyisocyanate).

TABLE 2

Composition of Undercoating Layer (G) 100 parts of a solution of vinyl chloride-vinyl acetate copolymer (MPR-TA, produced by Nisshin Kagaku Co.) in methyl ethyl ketone (3 wt%) and 6 parts of a solution of an adduct of tolylenediisocyanate and trimethylol propane (Colonate, produced by Nippon Polyurethane Ind. Co.) in butyl acetate (10 wt%).

(H) The same as (G) except that the above-described Colonate is not present.

(I) 100 parts of a solution of vinyl chloride-vinylidene chloride copolymer (Saran, produced by Asahi Dow Co.) in tetrahydrofuran (5 wt%) and 6 parts of the same solution of Colonate (as described above).

(J) The same as (I) except that Colonate is not present.

These samples (G) to (J) were exposed to light and developed by a heat roll in the same manners as in Example 1, and photographic properties and quality of film were examined. The results are shown in Table 3.

TABLE 3

| | Photographic Property *1 Fog | D max | Relative Sensitivity *2 | Film Quality *1 Generation of Bubbles | Shear of Image |
|---|---|---|---|---|---|
| (G) | 0.05 | 1.30 | 100 | None | Normal image |
| | (0.05) | (1.30) | (94) | (") | (Normal image) |
| (H) | 0.06 | 1.32 | 103 | Generation | Shear of image occurred |
| | (0.08) | (1.31) | (95) | (") | (Shear |

TABLE 3-continued

| | Photographic Property *1 | | | Film Quality *1 | |
|---|---|---|---|---|---|
| | Fog | D max | Relative Sensitivity *2 | Generation of Bubbles | Shear of Image |
| | | | | | of image occurred) |
| (I) | 0.04 | 1.40 | 103 | None | Normal image |
| | (0.05) | (1.36) | (95) | (") | (Normal image) |
| (J) | 0.05 | 1.44 | 105 | Generation | Shear of image occurred |
| | (0.07) | (1.40) | (96) | (") | (Shear of image occurred) |

*1The value and the valuation shown in parentheses are those obtained in case that each sample was allowed to stand for 14 days at 35° C. and 65% relative humidity (Compulsory deterioration).

*2Relative values based on the sensitivity of Sample (G) which was not subjected to compulsory deterioration (inverse number of exposure necessary to give the density of fog + 0.1) being 100.

It is understood from Table 3 that the polyisocyanate of the present invention prevents generation of bubbles and shear of images observed in the heat-developable photosensitive materials having an undercoating layer and that the effect thereof is excellent regardless of the polymer in the undercoating layer. Further, it is understood that the polyisocyanate of the present invention does not have a bad influence upon the improvement of green storage stability caused by the undercoating layer composed ov vinyl chloride type or vinylidene chloride type copolymer.

EXAMPLE 5

A coating solution for the sensitive layer of Example 1 was prepared. In carrying out application of it to a paper support described in Example 1, a 10 wt% solution of polyvinyl butyral in an isopropanol-ethyl acetate solvent mixture (isopropanol:ethyl acetate 80:20 (ratio by volume)) was prepared as a coating solution for the top coating layer. These two coating solutions were applied at the same time by means of a multilayer simultaneous coating apparatus described in U.S. Pat. No. 2,761,791 to prepare heat-developable photosensitive materials.

In this case, sample (K) was produced by applying with the addition of 25% by weight based on polyvinyl butyral, of an adduct of hexamethylenediisocyanate (adduct of 3 mols of hexamethylenediisocyanate and 1 mol of trimethylol propane) to the above-described coating solution for the top coating layer. On the other hand, sample (L) was produced without using the adduct.

These samples were exposed to light and developed by the same manners as in Example 1 and photographic properties and quality of film were examined. Results are shown in Table 4.

TABLE 4

| | Photographic Property | | | |
|---|---|---|---|---|
| | Fog | D max | Relative sensitivity* | Film Quality |
| (K) | 0.08 | 1.22 | 85 | Adhesion of the coating film and shear of images did not occur. |
| (L) | 0.07 | 1.28 | 100 | The coating file adhered to the roll and shear of images occurred. |

*Relative value based on the sensitivity of (L) (inverse number of exposure necessary to give the density of fog + 0.1) being 100.

In order to carry out multilayer simultaneous application of systems comprising organic solvents as shown in this example, it is preferred to use the same binder for both layers, because the solvent compositions resemble each other to prevent cohesion of solutes at the interface and surface tension of the upper layer and that of the lower layer are easily balanced. However, polyvinyl butyral used often for the heat-developable photosensitive materials has poor abilities as a polymer for the top coating layer, and the coating film adheres to the heat roll as shown in the result of sample (L). On the contrary, if the adduct of polyisocyanate of the present invention be used, such troubles can be prevented. Accordingly, it is understood that the polyisocyanate of the present invention show an effect of improving film properties of the heat-developable photosensitive materials produced by multilayer simultaneous application.

Comparative Example

Samples were prepared in the same manner as in Example 1 except that the hardening agents shown in Table 5 were used instead of the adduct of hexamethylenediisocyanate and trimethylol propane in Example 1. In all cases, adhesion of the coating film to the developing roll resulted.

TABLE 5

| Generic Name | Example | Amount Added | Result |
|---|---|---|---|
| Aldehydes | $OHC\text{-}(CH_2)_6\text{-}CHO$ | 6g/l of coating solution | Shear of image occurred |
| Blocked Aldehydes | 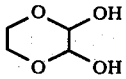 | 6g/l of coating solution | Large shear of image occurred |
| Ketones | Methyl ethyl ketone | 6g/l of coating solution | Large shear of image occurred |
| Carboxylic and Carbonic Acid Derivatives | Ethyl acetate | 6g/l of coating solution | Large shear of image occurred |
| Sulfonate Esters | $CH_3SO_2\text{-}O\text{-}(CH_2)_3\text{-}O\text{-}SO_2CH_3$ | 6g/l of coating solution | Large shear of image occurred |
| Sulfonyl Halides | 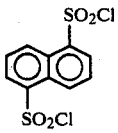 | 6g/l of coating solution | Large shear of image occurred |
| Vinyl Sulfonyl Esters | $(CH_2{=}CH\text{-}SO_2\text{-}CH_2)_2\text{-}O$ | 6g/l of coating solution | Large shear of image occurred |

TABLE 5-continued

| Generic Name | Example | Amount Added | Result |
|---|---|---|---|
| Active Halogen Compounds | 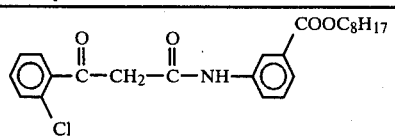 | 6g/l of coating solution | Large shear of image occurred |
| Epoxy Compounds | 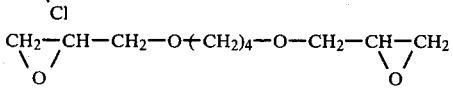 | 6g/l of coating solution | Large shear of image occurred. Further, high coloration of nonexposed area occurred after treatment. |
| Aziridines | 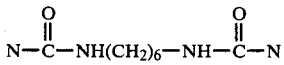 | 6g/l of coating solution | Shear of image occurred. |
| Active Olefins | 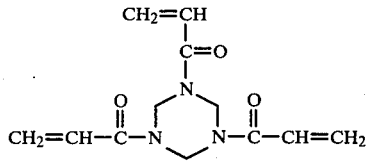 | 6g/l of coating solution | Large shear of image occurred. |
| Carbodiimides | 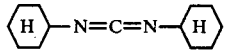 | 6g/l of coating solution | Shear of image occurred. |

The results in Table 5 demonstrate the drawbacks which arise when many hardening agents which are known for use in gelatino silver halide emulsions, are used in a heat-developable materials.

While the invention has been described in detail and with reference to specific embodiment thereof, it will be apparent to one skilled in the art that various changes and modifications cn be made therein without departing from the spirit and scope thereof.

What is claimed is:

1. In a heat-developable photosensitive material comprising a support having coated thereon at least one sensitive layer comprising (a) a binder and at least one of (b) an organic silver salt, (c) a photocatalyst, and (d) a reducing agent, the improvement which comprises said heat-developable photosensitive material additionally containing (e) a polyisocyanate.

2. The heat-developable photosensitive material according to claim 1, wherein said component (e) is contained in said sensitive layer.

3. The heat-developable photosensitive material according to claim 1, wherein said component (e) is contained in an undercoating layer provided between said sensitive layer and said support.

4. The heat-developable photosensitive material according to claim 1, wherein said component (e) is contained in a top coating layer provided on said sensitive layer.

5. The heat-developable photosensitive material according to claim 1, wherein said component (e) is selected from isocyanates having at least two isocyanate groups and adducts thereof.

6. The heat-developable photosensitive material according to claim 1, wherein said component (e) is present in an amount of about 0.01 to 50 parts based on 100 parts of the whole binders on the support.

7. The heat-developable photosensitive material according to claim 1, wherein the polyisocyanate of said component (e) is an adduct of isocyanates having at least two isocyanate groups and dihydric or trihydric alcohols.

8. The heat-developable photosensitive material of claim 1 wherein said binder is polyvinyl butyral.

9. The heat-developable photosensitive material of claim 3, wherein said undercoating layer is a layer of a vinylchloride or vinylidene chloride copolymer.

10. The heat-developable photosensitive material of claim 1, wherein said material additionally contains a toner.

11. In a process for preparing a heat-developable photosensitive material comprising a support having coated thereon at least one sensitive layer containing (a) a binder and at least one of (b) an organic silver salt, (c) a photocatalyst, and (d) a reducing agent, in which a photosensitive composition containing said components (a) to (d) and one or more compositions for one or more auxiliary layers are simultaneously coated upon said base, the improvement which comprises one of said compositions or said support containing (e) a polyisocyanate.

12. The process of claim 11, wherein said component (e) is present in said composition for said sensitive layer.

13. The process of claim 11, wherein said auxiliary layer is an undercoating layer and said component (e) is present in the composition for said undercoating layer.

14. The process of claim 11, wherein said auxiliary layer is a top coating layer and said component (e) is present in the composition for said top coating layer.

15. The process of claim 11, wherein one of said auxiliary layers is a top coating layer and another of said auxiliary layers is an undercoating layer and said component (e) is present in the composition for said top coating layer and/or the composition for said undercoating.

* * * * *